United States Patent [19]

Brunn

[11] Patent Number: 4,762,362

[45] Date of Patent: Aug. 9, 1988

[54] FOLDING PIECE OF FURNITURE

[76] Inventor: Oswald Brunn, Bunzlauer Platz 1, 8000 Munich 50, Fed. Rep. of Germany, D-8000

[21] Appl. No.: 83,608

[22] Filed: Aug. 7, 1987

[30] Foreign Application Priority Data

Oct. 14, 1986 [DE] Fed. Rep. of Germany ..... 3634986

[51] Int. Cl.[4] ..... A47C 4/00

[52] U.S. Cl. ..... 297/26; 108/117; 297/439

[58] Field of Search ..... 297/26, 25, 24, 35, 297/439; 108/116, 117, 118; 182/175

[56] References Cited

U.S. PATENT DOCUMENTS

| | | | |
|---|---|---|---|
| 246,702 | 9/1881 | Arnold | 297/26 |
| 654,760 | 7/1900 | Pace | 108/116 |
| 1,301,874 | 4/1919 | Poland | 108/116 |
| 1,809,866 | 6/1931 | Riesche | 108/116 |
| 2,646,634 | 7/1953 | Mongar | 108/116 |

FOREIGN PATENT DOCUMENTS

| | | | |
|---|---|---|---|
| 803,931 | 4/1951 | Fed. Rep. of Germany | 297/26 |
| 2,390,921 | 1/1979 | France | 297/26 |
| 552,908 | 12/1956 | Italy | 297/35 |
| 203,890 | 9/1923 | United Kingdom | 297/26 |

*Primary Examiner*—Francis K. Zugel
*Attorney, Agent, or Firm*—Townsend & Townsend

[57] ABSTRACT

Folding piece of furniture, in particular folding stool, which comprises a seat face and leg pairs arranged laterally of the seat face. The seat face is provided with a means for mounting one of the two leg pairs and for guiding the other leg pair. These means permit an adjustment of the inclination of the seat face with respect to the second leg pair and also permit the collapsible piece of furniture to be folded up into an extremely compact form.

10 Claims, 4 Drawing Sheets

FOLDING PIECE OF FURNITURE

This invention relates to a folding piece of furniture according to the preamble of claim 1.

Folding or collapsible furniture, in particular folding stools, are known per se. These folding stools have the disadvantage that the seat face is not adjustable as regards its inclination.

The invention is therefore based on the problem of providing a folding piece of furniture, in particular a folding stool, in which the inclination of the seat face is adjustable whilst retaining a compact form in the collapsed state of the folding stool.

The folding stool according to the invention has the advantage that its seat face can be adjusted in simple manner and in spite of this adjustability the folding stool has a minimum space requirement in the collapsed state. It is particularly advantageous that the seat face when the folding stool is collapsed comes to lie completely between the leg pairs lying parallel to each other. A further advantage is that according to a preferred embodiment the leg pair can be fixedly arrested in various detent grooves thereby excluding if desired a collapsing of the stool by unintentional contact or shifting.

A further advantage resides in that the folding stool according to the invention can be used by simple fitting of a backrest as seat with backrest with the possibility of adjusting the inclination of the seat face.

Hereinafter preferred embodiments of the folding piece of furniture according to the invention will be described with the aid of the drawings to explain further features In the drawings.

The folding piece of furniture according to the invention, hereinafter referred to as folding stool, comprises as usual a seat face denoted by 1 and two pairs of legs. The legs of the one pair, preferably the front pair, are designated in FIG. 1 by 3 and the legs of the rear pair by 2.

Figure 1:
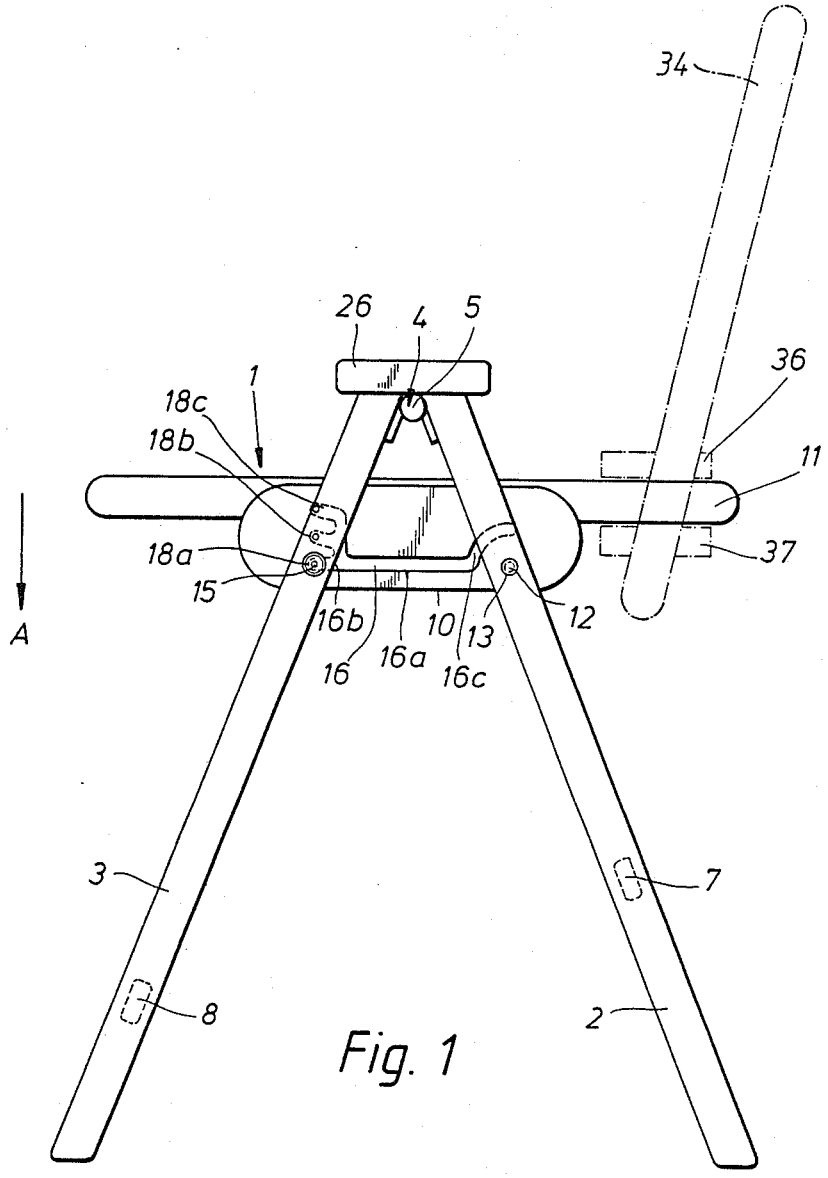
FIG. 1 is a side elevation of the folding piece of furniture.
Figure 2:
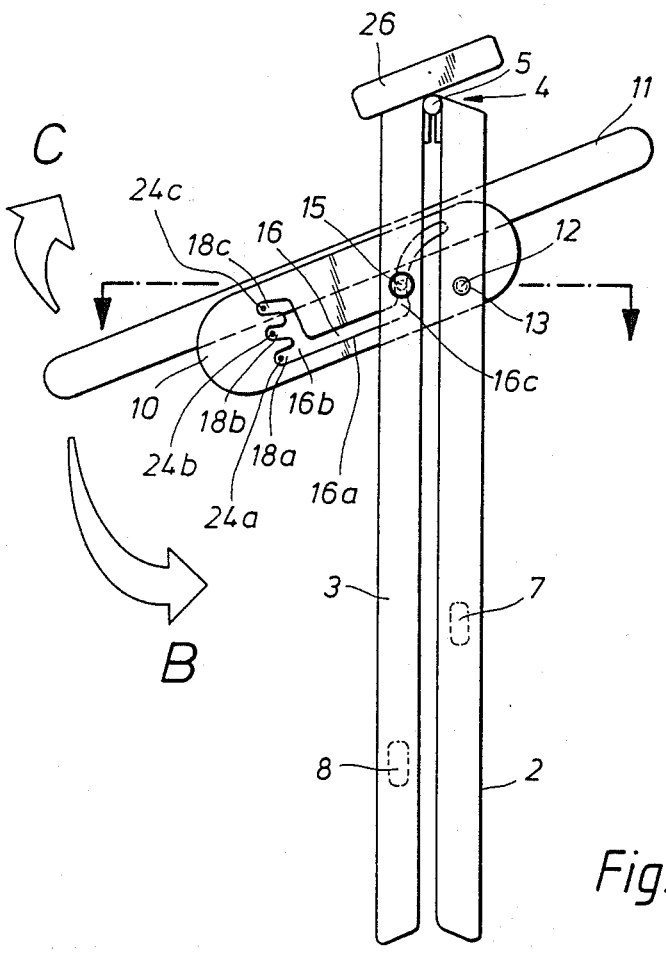
FIG. 2 is a side elevation of the folding piece of furniture in the almost collapsed state.

The associated legs 2, 3 of the two leg pairs are connected pivotally together as shown in FIG. 1 by a joint 4, preferably in the form of a hinge. In the embodiments of FIGS. 1 and 2 the axis of rotation of the two associated legs 2, 3 is defined by a bearing pin 5 of the joint 4 so that in this embodiment the rotation or pivot axis between in each case a leg 2, 3 is fixed at the upper end thereof. At the downwardly pointing end between each leg pair a stabilizing transverse strut 7 and 8 respectively is provided. For mounting and guiding the two leg pairs a means designated by 10 is provided which in a preferred embodiment consists of a plate pair 10. Each plate 10 is preferably secured to the side frame 11 of the seat face 1 and comprises a bearing sleeve or bush 12 serving to receive a bearing pin or fillister-head screw 13 and provided in the latter case with an internal thread for holding the screw. An outer thread of the bearing sleeve serves for the fixed arrangement thereof in the associated bore, not designated, of the respective plate 10. The head of the screw 13 engages in one embodiment over the associated bore in the leg 2, the screw 13 runs through the leg 2 and is screwed into the sleeve 12 which is fixedly mounted in the plate 10 It is essential that each of the legs 2 be pivotally mounted with respect to the plate 10. For assembly and disassembly the screw can be screwed in and out of the sleeve 12. Any other mounting means permitting pivotal movement between the leg 2 and plate 10 can be used which in the assembled state prevents a lateral movement of the legs 2 away from the plate 10.

Each leg 3 is displaceable along a guide groove 16 by means of a guide pin 15 or the like which is preferably fixedly inserted into the associated leg 3 and is directed towards the inside, i.e. in the direction towards the plate 10. In the embodiment of the folding stool illustrated in FIG. 1 the guide groove 16 consists essentially of three regions, that is a substantially straight region **16*a* adjoined on the left in FIG. 1 by a region 16*b* having two or more detent grooves 18*a*, 18*b*, 18*c*, etc. On the right side in FIG. 1 the guide groove 16 merges into a region 16*b* which has an arcuate path. The detent grooves 18*a* etc. lie substantially above each other. On engagement of the guide element 15 into the various detent grooves 18*a*, etc., a different inclination setting of the seat face 1 may be set and thus a different inclination thereof with respect to the legs 3**.

Figure 3:
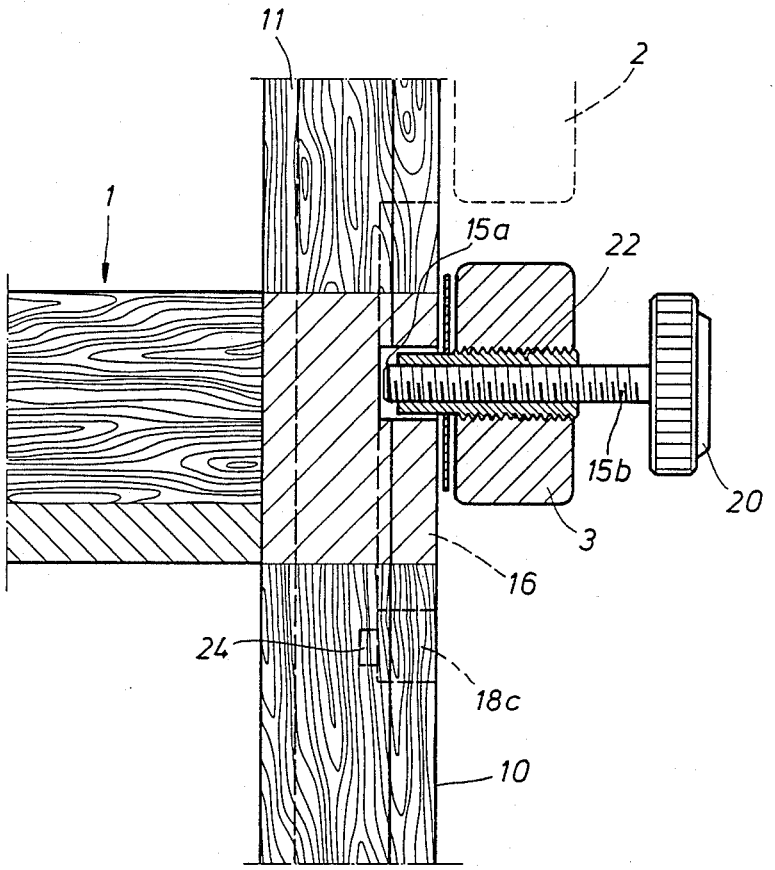
FIG. 3 is a partial sectional view of the folding piece of furniture to clearly illustrate a preferred embodiment thereof with guide groove and arrestable guide element.

FIG. 2 shows a side view of the folding stool in the almost collapsed state. If the folding stool is collapsed out of the position shown in FIG. 1 by pivoting the leg pair 3 about the pin 5 clockwise onto the leg pair 2 the guide element 15 slides out of the respective detent groove **18*a* 18*b*, etc., into the substantially straight region 16*a* until the two leg pairs 2, 3 according to FIG. 2 reach a position where they are parallel to each other. As soon as the two leg pairs 2, 3 have reached the parallel position shown in FIG. 2 the guide element 15 moves into the arcuately extending region 16*b* and in accordance with FIG. 2 the seat face 1 can then be pivoted downwardly in the direction of the arrow B until it comes to lie in the plane of the leg pairs 2, 3 between the latter. During the movement of the seat face 1 in the direction of the arrow B the arcuate guide groove region 16*c* is moved in the clockwise direction whilst the guide element 15 remains stationary and thus a sliding movement takes place between the guide element 15 and the groove region 16*c* up to the end of the arcuate groove. In the embodiment illustrated in FIG. 2 the arcuate guide groove region 16*c* lies on a circle about the axis of rotation defined by the sleeve 12, the radius of the arc of the groove portion 16*c* about this axis of rotation corresponding to the distance shown in FIG. 2 between the axis of the sleeve 12 and the guide element 15 FIG. 3 shows details of a preferred guide element 15 which consists of a sleeve 22 with inner and outer thread, a threaded pin 15 and a knurled head 20 or the like The threaded pin 15 is screwed through the threaded sleeve 22 which is provided in each of the two plates 10. The threaded sleeve 22 may preferably have a length which is greater than the thickness of the leg 3 so that the threaded sleeve 22 with its end facing the plate 10 engages into the guide groove 16 and serves as guide element with respect to said groove 16. The purpose of the threaded pin here is, on engagement into one of the detent grooves 18*a*, etc., to engage into a depression at the end of each detent groove 18*a*, 18*b*, the depression of the detent grooves being indicated by the reference numeral 24 in FIG. 3. This has the advantage that when the collapsible stool is unfolded and the threaded sleeve 22 engages into one of the detent grooves 18***a*, 18*b*, etc., by means of the knurled head 20 or the like the threaded pin 15*a* can be turned forwardly until it engages into the depression 24*a*, 24*b*, etc., of the associated detent groove 18*a*, 18*b*, etc., and thereby prevents disengagement of the sleeve 22 from said detent groove. When the threaded pin 15*a* is engaged in this manner it is ensured that unintentional shifting of the guide sleeve 22 out of the detent grooves 18*a* is prevented, shifting of the leg pair 3 in the direction towards the leg pair 2 and thus undesired collapsing of the folding stool thereby also being excluded. Instead of the sleeve projecting from each leg 3 laterally into the guide grooves 16 the pin 15*a* can perform the guide function along the guide groove 16 if it has a smooth circumference over its length engaging into the guide groove 16, i.e. is not formed with an outer thread and the sleeve 22 does not project out of the plate 10, i.e. has a length corresponding to the plate thickness.

Furthermore, a depression corresponding to the depression 24 can be provided at the end of the guide region 16*c* remote from the guide groove region 16 for the purpose of obtaining an arresting of the folding stool in the position in which the leg pairs 2, 3 have reached the parallel attitude shown in FIG. 2 and the seat face 1 is folded in the direction of the arrow B in FIG. 2 into the plane of the leg pairs 2, 3. In this manner it is possible to prevent unintentional unfolding of the collapsible stool, for example during transport thereof.

FIG. 1 shows the folding stool in a position ready for operation in which the guide element 15 or 22 engages into the lowermost detent groove 18*a* so that the seat face 1 is substantially horizontally aligned. If the guide element 15 or 22 is engaged into one of the upper detent grooves 18*b*, 18*c*, etc., a greater or lesser inclination of the seat face 1 with respect to the horizontal is achieved For this purpose the two leg pairs 2, 3 must be moved slightly towards each other so that the guide element 15 can come out of the detent groove 18*a*, then move upwardly and into the detent groove 18*b* or 18*c*. At the same time the seat face 1 executes a pivot movement in the direction of the arrow A. From each of the various detent positions the folding stool can immediately be brought into the completely collapsed state provided that the threaded pin 15*a* in the example of embodiment of FIG. 3 does not engage into one of the depressions 24 so that a displacement of the guide element 15 for example out of the detent groove 18*c* into the detent groove 18*a* is not necessary and the guide pin 15 can be moved immediately into the region 16*a* and then into the region 16*c*.

It has been found advantageous if in the state of the stool shown in FIG. 2 the mounting 12, 13 and the guide pin 15 lie substantially at the same level. The size of the seat face 1 and the arrangement of the cross struts 7, 8 is such that between the upper edge of the legs 2, 3 in FIG. 2 and the cross struts 7, 8 there is adequate space available to permit pivoting of the seat face 1 into this intermediate space.

As FIGS. 1 and 2 show in the embodiment illustrated at the upper end face of legs 3 a support element 26 is secured on which the upper end face of the leg 2 engages when the folding stool is extended Instead of the plates forming the means 10 other parts may be provided which perform the bearing and guide functions described above, and these parts can be made as separate parts to be secured to the side frame 11 or as parts integral with the side frame 11.

Figure 4:
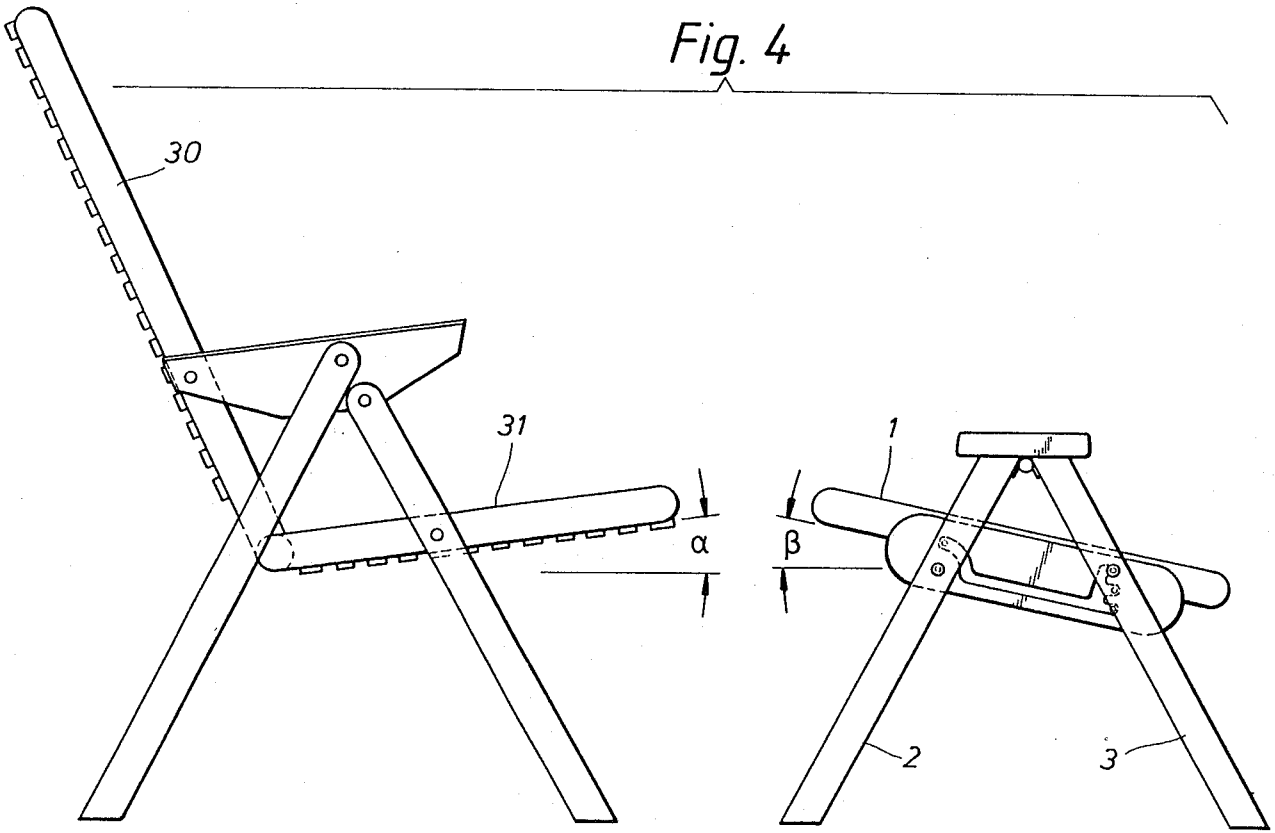
FIG. 4 shows the use of the folding stool according to the invention as footrest for a folding chair.

Due to the inclination adjustability of the seat face of the stool according to the invention said collapsible stool can be used particularly advantageously as auxiliary part to the chair according to German patent application Nos. P36 07 581 or P 36 07 619 and by varying the setting of the folding piece of furniture or folding chair permits optimum adaptation to the body form when used as footrest. FIG. 4 shows the use of the folding stool according to the invention in conjunction with a collapsible chair, preferably a folding chair according to patent application Nos. P36 07 581 or P 36 07 619. As apparent from FIG. 4 the inclination of the seat face 1 can be adjusted such that it is opposite to the inclination of the seat or resting face of the folding chair or armchair designated by 30, the seat of which, designated by 31, is inclined to the rear at an angle $\alpha$ to the horizontal whilst the inclination of the seat face 1 of the folding stool to the horizontal corresponds to the angle $\beta$, and $\alpha$ may be equal to $\beta$ and thereby the setting of the footrest formed by the face 1 in conjunction with the inclination of the seat face 31 of the chair can be adjusted to the most comfortable position.

According to a further development of the invention an additionally fittable backrest part may be attached to the seat face 1, for example in the form of the element 31 drawn in dashed line in FIG. 1. The frame of the backrest 34 has on either side at its sides e.g. support members 36, 37 which engage round the seat face 1 or side frame 11 of the seat face 1 and by a clamping action locate the backrest 34 with respect to the side frame 11. In this manner the folding stool according to the invention with adjustable seat face 1 can also be used as stool with backrest and the backrest is adjustable in inclination together with the seat face 1.

According to FIG. 1 the backrest 34 is fitted onto the seat face 1 from the right. Preferably, the backrest 34 is fitted onto the seat face 1 from the left and in this manner a comfortable adjustment of the backrest inclination with appropriate adjustment of the inclination of the seat face 1 is possible. In the latter case the backrest is at a short distance from the adjusting and detent mechanism consisting of the elements 15, 18

Above, substantially only one side of the stool has been described; the same also of course applies to the other side of the stool not shown in FIGS. 1 and 2

The folding piece of furniture according to the invention can be used particularly advantageously also as footrest, for example for suites or the like. The face 1 can possibly be upholstered or provided with a cloth cover or the like and serves as foot support surface

I claim:

1. A folding piece of furniture such as a stool comprising:

a seat portion;

a first leg pair and a second leg pair, each pair disposed laterally on opposing sides of said seat portion;

a first plate including a first guiding groove and a first bearing pin, said first bearing pin rotatably connecting said first plate to a chosen leg of said first leg pair;

a second plate including a second guiding groove and a second bearing pin, said second bearing pin rotatably connecting said second plate to a chosen leg of said second leg pair;

each said first and second guiding grooves being shaped to define a substantially straight groove region substantially parallel to said seat portion, an arcuate groove region merging with one end of said straight region and adjoining a bearing pin, and a plurality of detent grooves at various heights above said straight region merging with a second end of said straight region;

a guiding pin, attached to each leg not rotatably connected to a plate, adapted to engage a guiding groove in a plate;

whereby when folded, each guiding pin engages an arcuate section of a guiding groove enabling a substantially parallel displacement of each leg pair, and when unfolded for seating each guiding pin engages a chosen detent groove allowing the seat portion to be variably inclined.

2. A folding piece of furniture such as a stool comprising:

a seat including a left side, a right side, a front side, a back side and a seat face;

a first plate including an inner side, an outer side, a front, a back and a first guiding groove, on said outer side, defined by a substantially straight central grooved region substantially parallel to said left seat side, an arcuate grooved region proximate the plate back and merging with a first end of said central grooved region, and, proximate the plate front and merging with a second end of said central grooved region, a plurality of curved detent grooves at various heights above said central grooved region, each said curved detent groove terminating at an end, whereby said inner side of said first plate is affixed to said left side of the seat attaching said first plate laterally to said left side;

a second plate including an inner side, an outer side, a front, a back and a second guiding groove, on said outer side, defined by a substantially straight central grooved region substantially parallel to said right seat side, an arcuate grooved region proximate the plate back and merging with a first end of said central grooved region, and, proximate the plate front and merging with a second end of said central grooved region, a plurality of curved detent grooves at various heights above said central grooved region, each said curved detent groove terminating at an end, whereby said inner side of said second plate is affixed to said right side of the seat attaching said second plate laterally to said right side;

a front left leg and a back left leg pivoally joined together at the leg tops, said back left leg being rotatably mounted to said back of said first plate proximate and below said arcuate grooved region of said first guiding groove;

a front right leg and a back right leg pivotally joined together at the leg tops, said back right leg being rotatably mounted to said back of said second plate proximate and below said arcuate grooved region of said second guiding groove;

a first guiding pin, including a projecting end facing said first plate, mounted in said left front leg and adapted to engage and slide within said first guiding groove with said projecting end; and a second guiding pin, including a projecting end facing said second plate, mounted in said right front leg and adapted to engage and slide within said second guiding groove with said projecting end;

whereby the seat face inclination is varied from chosen substantially horizontal seating dispositions to a substantially vertical storage disposition, placing all legs in a substantially parallel disposition, by slidingly engaging said first and second guide pins with different portions of said first and second guiding grooves.

3. The folding piece of furniture of claim 2 wherein:

the end of each said curved detent groove in said first guiding groove and in said second guiding groove includes a detent depression adapted to receive a locking pin;

the projecting end of said first guiding pin includes a first locking pin adapted to engage a detent depression in said first guiding groove; and the projecting end of said second guiding pin includes a second locking pin adapted to engage a detent depression in said second guiding groove;

said first guiding pin is retractably mounted in said left front leg; and said second guiding pin is retractably mounted in said right front leg;

whereby said seat face is locked in a chosen disposition by engaging said first locking pin in a chosen detent depression in said first guiding groove, and engaging said second locking pin in a chosen detent depression in said second guiding groove.

4. The folding piece of furniture of claim 2 wherein:

said first guiding pin includes a sleeve projecting from said left front leg, and said second guiding pin includes a sleeve projecting from said right front leg.

5. The folding piece of furniture of claim 2, further including a removable backrest attached at a chosen front or back of said seat.

6. Folding piece of furniture according to claim 1 wherein the guide groove comprises depressions in the region of the detent grooves.

7. Folding piece of furniture according to claim 6, wherein the guiding pin is formed by a sleeve which projects laterally from the associated leg.

8. Folding piece of furniture according to claim 6, wherein the guiding pin is formed by a pin.

9. Folding piece of furniture according to claim 1 wherein the guiding pin comprises an arresting pin.

10. Folding piece of furniture according to claim 1 comprising an attachable backrest.

* * * * *